US006772889B2

(12) United States Patent
Moceri

(10) Patent No.: US 6,772,889 B2
(45) Date of Patent: Aug. 10, 2004

(54) SHELF STRUCTURE FOR HOLDING WET APPAREL AND FOOTWEAR

(76) Inventor: James L. Moceri, 15644 Hemlock, Macomb Township, MI (US) 48044

( * ) Notice: Subject to any disclaimer, the term of this patent is extended or adjusted under 35 U.S.C. 154(b) by 140 days.

(21) Appl. No.: 10/135,055

(22) Filed: May 1, 2002

(65) Prior Publication Data

US 2003/0205545 A1 Nov. 6, 2003

(51) Int. Cl.[7] ..... A47F 5/08

(52) U.S. Cl. ..... 211/90.04; 211/36; 211/153; 211/87.01

(58) Field of Search ..... 211/183, 90.04, 211/90.01, 85.3, 90.02, 88.02, 86.01, 87.01, 134, 135, 151, 153, 36; 108/108, 141, 143

(56) References Cited

U.S. PATENT DOCUMENTS 507,233 A * 10/1893 Marshall ..... 211/85
3,028,973 A * 4/1962 Padgett ..... 211/87.01
3,224,357 A * 12/1965 Rubens ..... 99/340
3,640,389 A * 2/1972 Snyder ..... 211/187
4,756,582 A * 7/1988 Heien ..... 312/229
4,832,607 A * 5/1989 Dorrell ..... 434/429
5,109,990 A * 5/1992 Murphy et al. ..... 211/41.3
5,163,567 A * 11/1992 Betts, Sr. ..... 211/75
5,285,906 A * 2/1994 Wisnowski et al. ..... 211/70.5
6,395,417 B1 * 5/2002 Frazier ..... 429/49

* cited by examiner

*Primary Examiner*—Jennifer E. Novosad

(57) ABSTRACT

A wall mounted adjustable, shelf structure for organizing and facilitating drying of wet wearing apparel includes a tray and shelf with grooves for channeling water from the apparel to a removable receptacle. The shelf structure facilitates drying of the apparel and prevents soiling of floors, walls and the like.

3 Claims, 4 Drawing Sheets

SHELF STRUCTURE FOR HOLDING WET APPAREL AND FOOTWEAR

BACKGROUND OF INVENTION

Summary of Invention

This invention relates to a wall shelf structure for holding and facilitating the drying of wet weather wearing apparel. More particularly, this invention relates to a shelf assembly for organizing and facilitating drying of wet weather wearing apparel such as gloves, hats and shoes.

OBJECT OF THE INVENTION

It is a primary object of this invention to provide a convenient and flexible shelf assembly which facilitates organizing, drying and storing of wet weather wearing apparel and more particularly to organizing, drying and storing gloves, hats and shoes.

It is a further object of this invention to provide a shelf structure for organizing and facilitating drying of wet wearing apparel comprising a generally vertical supporting frame member including a generally planar support member, a shelf member mounted on the planar support member and extending there from at a small positive angle with respect to horizontal, said planar support member and said shelf member defining at least one opening allowing the flow of water under the influence of gravity along said planar support member, and a water trap mounted on the supporting frame member for collecting and holding water flowing downwardly from said shelf member.

It is a further object of the invention to provide a shelf structure as described in the previous object wherein said shelf member further comprises: a fixed shelf element, a movable shelf element operatively associated with said fixed shelf element and supported thereby for telescopic movement with respect thereto from a first retracted position to a second extended position with respect to said planar support member.

A still further object of the invention is to provide a shelf structure as described in the previous objects wherein the supporting frame member, shelf member, and water trap comprise a water impervious material. Another object of the invention is to provide a shelf structure as described in the prior objects wherein the water impervious material of the shelf structure is polypropylene.

A further object of the invention is to provide a shelf structure as described in the previous objects wherein said water trap is removably mounted on the supporting frame member below said shelf member.

Also, it is an object of this invention to provide a shelf structure as described in the above objects wherein the shelf member is provided with intersecting generally horizontal water grooves, and generally vertical water grooves which intersect and cooperate with openings in the tray and fixed shelf elements to provide water flow grooves from the tray and fixed shelf element to the water trap.

It is a still further object of the invention to provide a shelf structure as described in the preceding objects further including a tray located above said shelf member fixed to the shelf supporting member and including an opening in fluid communication with said vertical water grooves and an upwardly extending lip along the entire periphery of said tray.

Other objects and advantages of this invention will become apparent from the drawing and detailed description of the invention.

DESCRIPTION OF THE PRIOR ART

Rain, snow or ice covered wearing apparel, especially shoes and gloves, if left unorganized on the floor, are a nuisance, create a safety hazard and soil the floor. Also, when left to stand in water, the apparel will be subjected to premature decay and be ruined. Prior art organizing and drying devices for foul weather apparel include generally flat water-proof mats that lay on the floor. These mats effectively prevent soiling of the floor due to water but leave the shoes and other wet weather wearing apparel, such as hats, scarves and gloves on the floor usually in the path of traffic and much of the safety hazard and nuisance remain unabated. Other prior art drying racks include plastic or wire frames adapted to hold individual items of clothing such as hats and shoes.

DETAILED DESCRIPTION OF THE INVENTION

Figure 1:
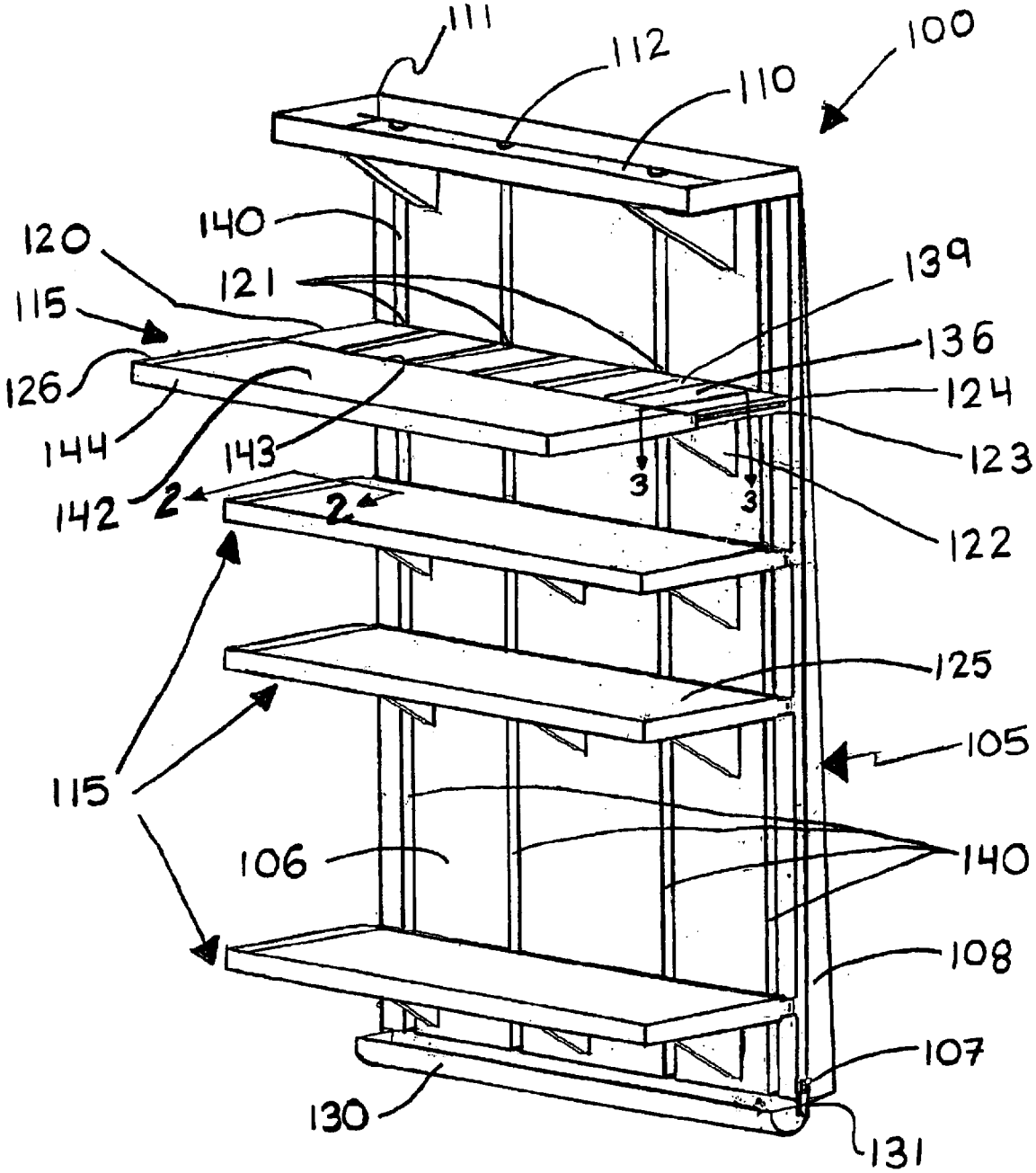
FIG. 1 is a perspective view of the wall shelf of the present invention.
Figure 2:
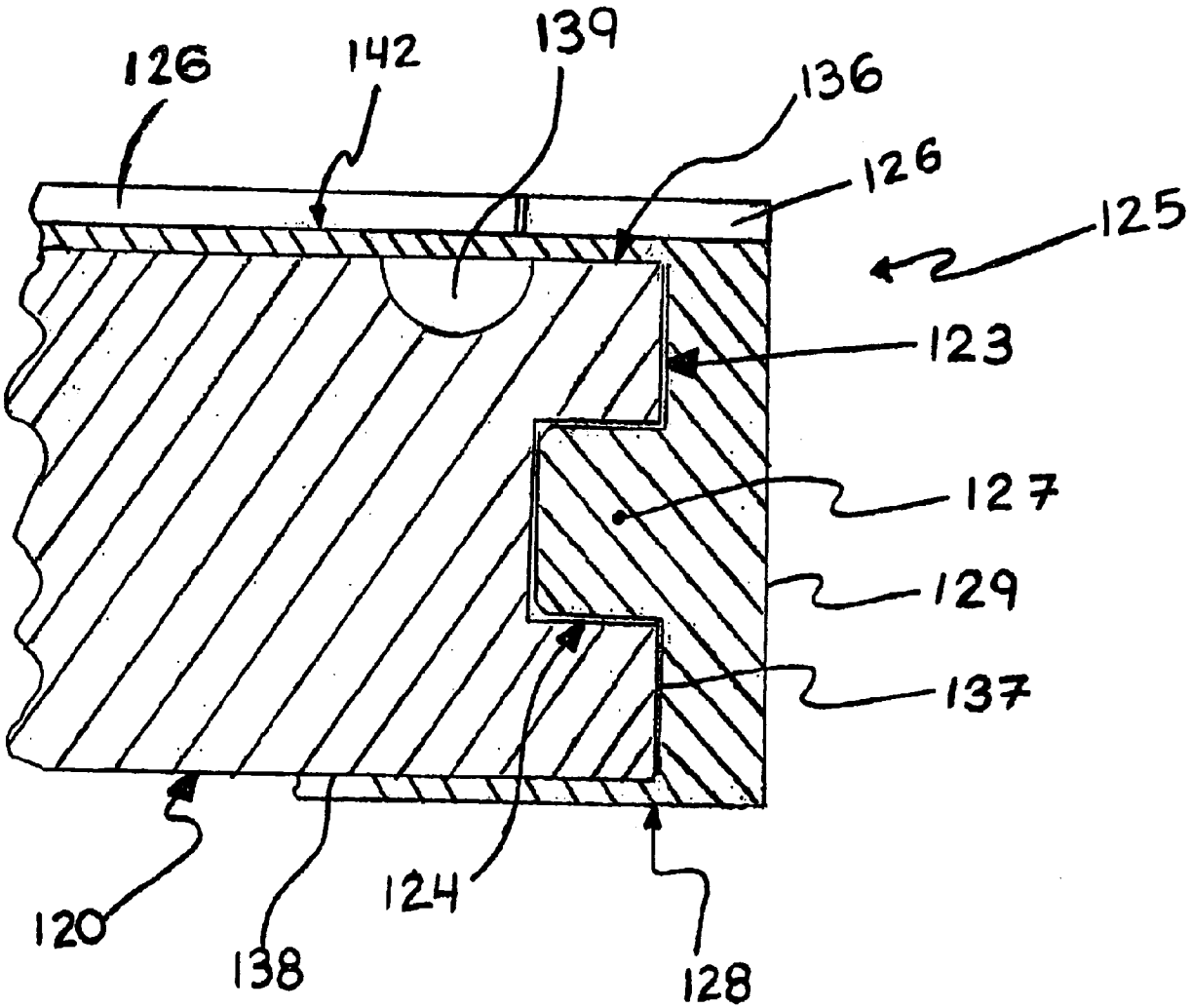
FIG. 2 is a partial detail view of a groove in the lateral edge of a fixed shelf element on the support member of the wall shelf of the present invention.
Figure 3:
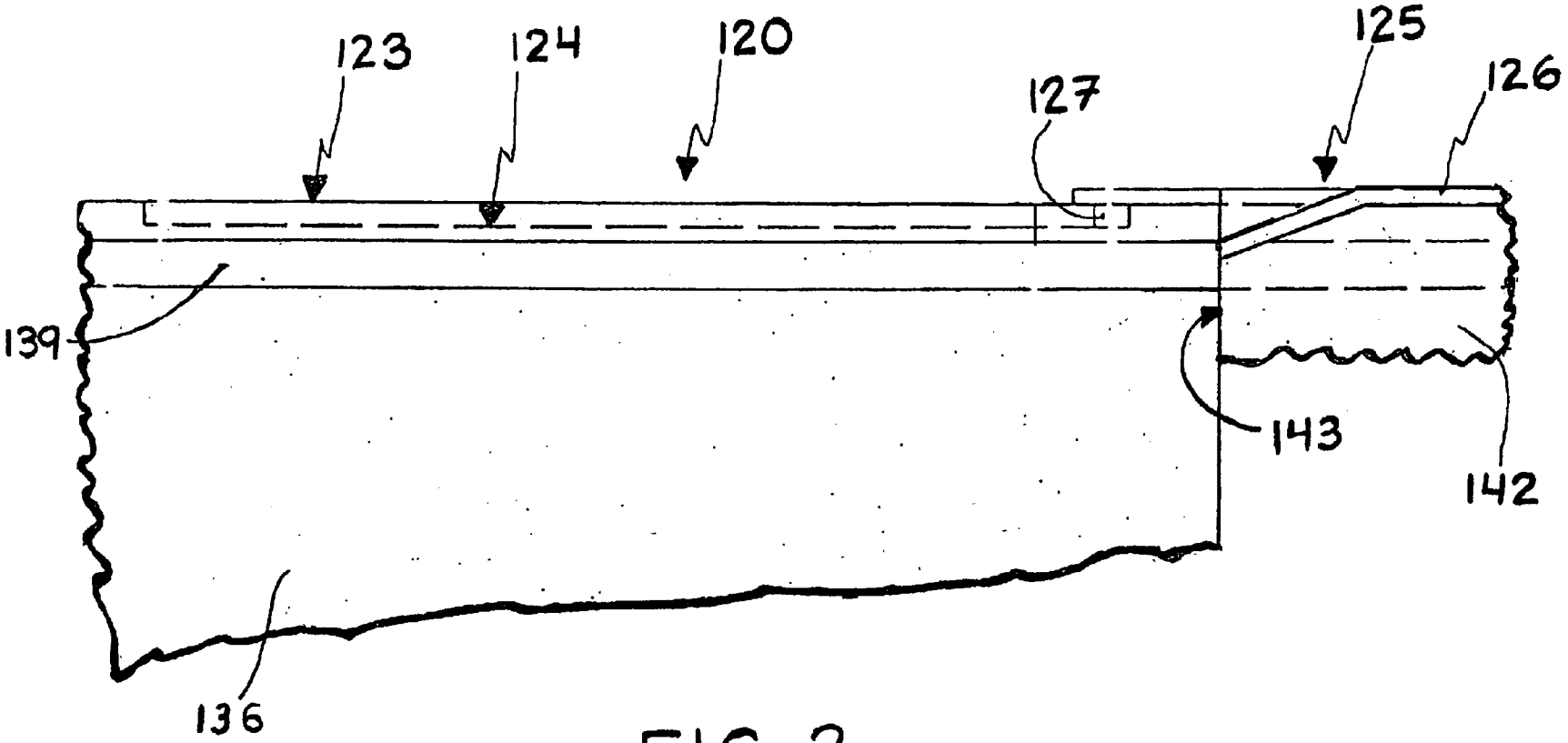
FIG. 3 is a partial sectional view showing construction of the groove used on an extensible shelf element included in the present invention.

The shelf structure 100 of the present invention is shown in FIGS. 1 through 3 of the drawing. The shelf structure 100 is especially adapted for organizing and facilitating drying of wet wearing apparel. As shown in FIG. 1, the shelf structure 100 includes a vertical supporting frame members 105. The shelf support frame member 105 includes a generally planar support member 106 and a frame element 108.

The supporting frame member 105 is preferably constructed of a molded relatively rigid thermoplastic material and is integral with the supporting frame members 105. In the preferred embodiment, the shelf structure comprises molded polypropylene. The supporting frame member 105 includes an integral tray 110 for holding wearing apparel such as hats and scarves or the like. The tray 110 includes a circumferential vertical lip 111 for containing water from apparel placed on the tray 110. Any water from apparel placed on the tray 110 flows under the influence of gravity toward the planar support member 106 and is directed to openings 112 in the tray 110.

The openings 112 permit water from tray 110 to flow downwardly in water grooves 140 located in the planar support member 106. The supporting frame member 105 supports one or more similar shelf assemblies 115 which may be evenly or unevenly spaced vertically along the planar support member 106 and shelf support brackets 122 extending from the planar support member 106.

Each shelf assembly 115 includes a fixed shelf element 120 extending from the supporting frame member 105 and a movable shelf element 125. The fixed shelf element 120 and the supporting brackets 122 can be molded integrally with the planar support member 106 or fixedly or removably attached to the planar support member 106 by any well known suitable fastening means such as welding, threaded fasteners or the like (not shown).

As shown in FIGS. 2 and 3, the movable shelf element 125 is mounted for telescoping movement with respect to the fixed shelf element 120. The movable shelf element 125 includes a planar top portion 126, a side portion 129, and a bottom bearing lip 128. Hence, the movable shelf element 125 is generally C-shaped and the top portion 126, side portion 129, and bottom bearing lip 128 define a cavity that mates with and corresponds to the exterior shape of the fixed shelf element 120 defined by the top surface 136, side surface 137 and a portion of the bottom surface 138 of fixed shelf element 120.

The fixed shelf element 120 thereby provides a cantilevered bearing support for the movable shelf element 125 and guides the telescopic movement of the movable shelf element 125 during extension and retraction with respect to the fixed shelf element 120. The movable shelf element 125 also includes a vertically extending lip 126 along substantially the entire outer periphery of the movable shelf element 125 to prevent water from flowing off the movable shelf element 125. The lip 126 on the movable shelf element 125 does not extend along the front edge 143 of the movable shelf element 125 thus permitting water to flow from the apparel onto the fixed shelf element 120 and into the water conducting grooves 139, 141 to openings 121 and into the vertical grooves 140. The shelf assembly 115, which includes the fixed shelf element 120 and movable shelf element 125, is supported by the planar support member 106, extends there from at a small positive angle with respect to horizontal when the planar support member 106 is mounted on a vertical surface such as a wall. The small positive angle allows water flow from the shelf assembly 115 toward the planar support member 105 to facilitate drying of apparel placed on the shelf assembly 115. The small positive angle can be provided to the fixed shelf element 120 in any of several convenient ways, e,g., the planar support member 106 can be biased from the vertical by an imposed by a varying increasing thickness of the supporting frame member 105 as is shown in FIG. 1, or the fixed shelf element 123 can have a small positive angle from the horizontal with respect to the planar support member 106 (not shown). As shown in FIG. 1, the supporting frame element 108 is provided with a varying thickness from thinner at the top to thicker at the bottom. The varying thickness provides the planar support member 106 with an angle of about 2.7 degrees from vertical. The shelf assembly 115 and the shelf elements 120 and 125 are preferably constructed of a readily moldable water impervious material such as polypropylene.

The movable shelf element 125 also includes a peripheral vertical lip 126 that contains water within the movable shelf element 125. As a result of the small positive angle of the shelf assembly 115 with respect to horizontal, water on the movable shelf element 125 will flow under the force of gravity to the fixed shelf element 120 and to the openings 121 and downwardly along the planar support member 106 to a water trap 131 located below the shelf assemblies 115. The water trap 131 can have any convenient configuration capable of collecting and retaining water but is shown as a generally semi-cylindrical tube. Preferably, the water trap 131 is also constructed of molded polypropylene.

As shown in FIG. 2, the fixed shelf element 120 includes a generally rectangular groove 124 in each lateral edge 123 of the fixed shelf element 120. The groove 124 cooperates with a boss 127 on the movable shelf element 125 to limit the telescopic movement of the movable shelf element 125 with respect to the fixed shelf element 120.

FIG. 3 illustrates a detail of construction of the movable shelf element 125. Specifically, FIG. 3 shows that the interior wall 126 of the movable shelf element 125 is provided with a generally c-shaped cross-section, The movable shelf element 125 surrounds and is supported by the fixed shelf element 120. The boss 127 limits the outward movement of the movable shelf element 125 and provides additional load bearing support for the movable shelf element 125 when in an outwardly extended position.

FIG. 1 also illustrates that planar support member 106 and said fixed shelf element 115 cooperate to define at least one opening 121 allowing the flow of water under the influence of gravity vertically in grooves 140 in said planar support member 106.

Figure 4:
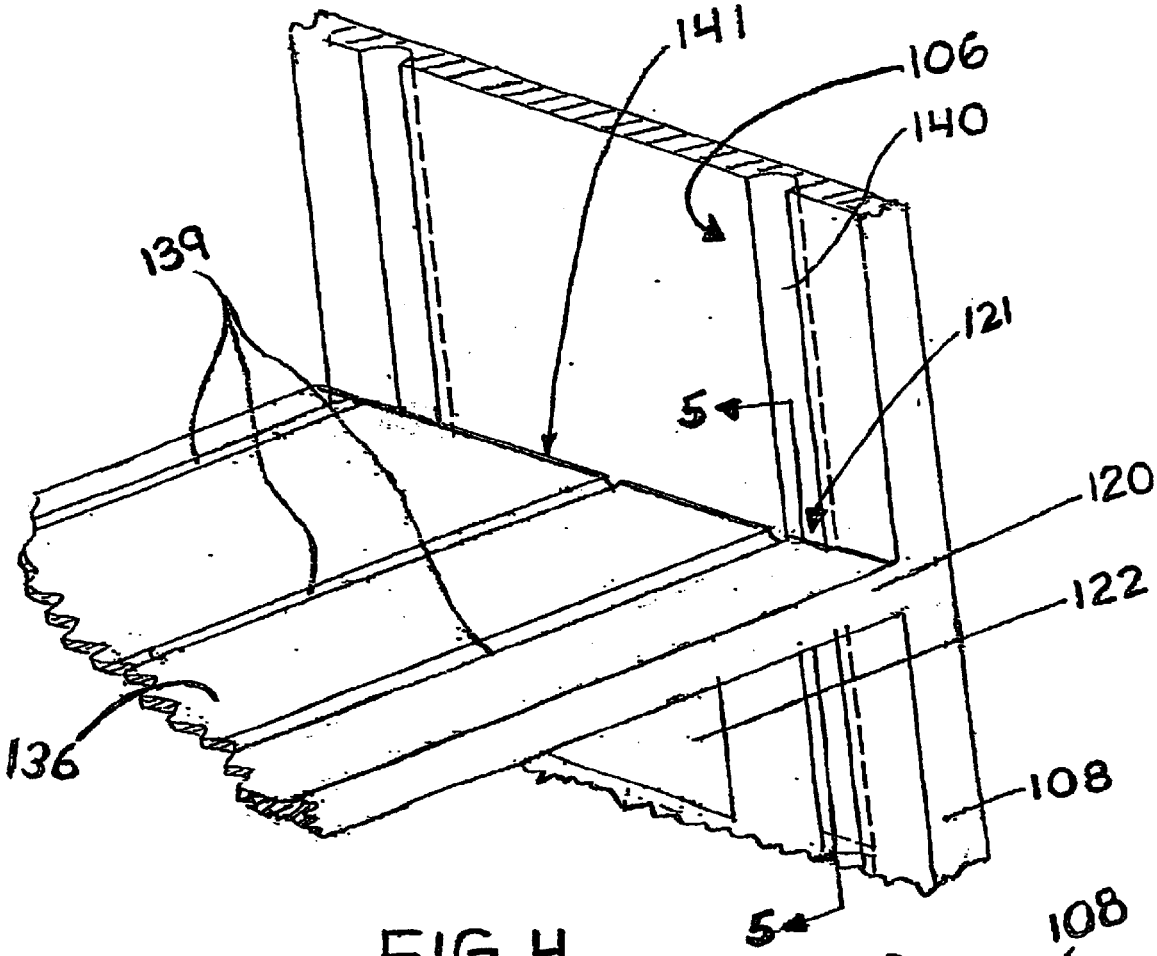
FIG. 4 is a partial enlarged perspective view of a portion of the wall shelf of the present invention showing grooves that control water flow from apparel to shelves to a water trap.

FIG. 4 shows water grooves 139 in the fixed shelf elements 120, water grooves 141 extending generally horizontally along the planar support member 106, and generally vertical water grooves 140 which channel water flow to the openings 121 and then to the water trap 130.

The generally vertical grooves 140 also intersect the openings 121.

Figure 5:
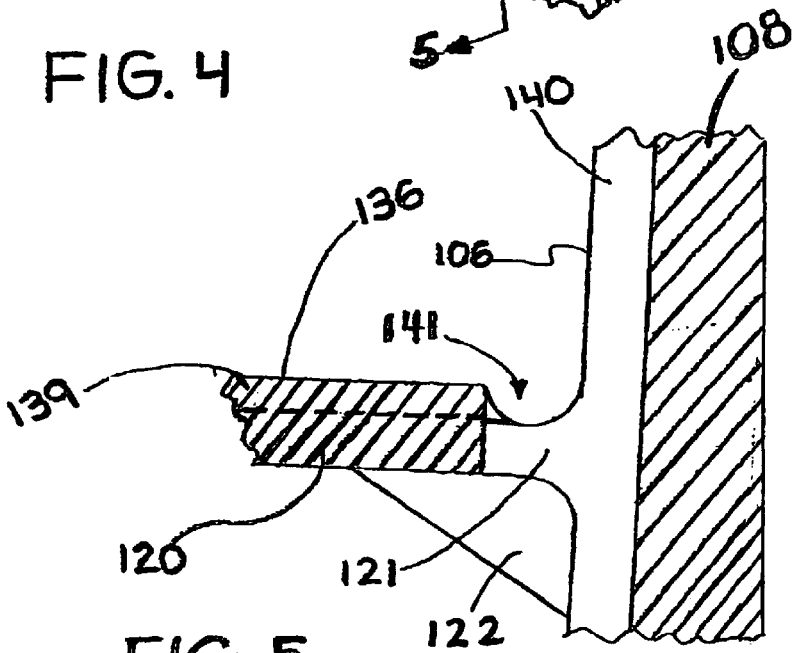
FIG. 5 is a sectional view taken along the line 5—5 and is a further enlargement of the perspective view of FIG. 4 showing the intersection of the water flow control grooves.

FIG. 5 shows the intersection of the water grooves 139, 140 and 141 and the openings 121 which channel the flow of water from wet apparel along the fixed shelf elements 120 to the water grooves 141 to the openings 112 and thence along the vertical water grooves 140 to the water trap 130.

Additionally, FIG. 1 shows the water trap 130 mounted on the supporting frame member 105 for collecting and holding water flowing downwardly from said shelf. The water trap 130 is removably supported on the supporting frame member 105 by pins 107 located in the supporting frame member 105. The water trap 130 includes flexible tabs 131. The flexible tabs 131 include opening therein which fit over and engage the pins 107 extending from the frame member 105 thereby holding the water trap 130 in position with respect to the planar support member 106 and permit removal thereof to allow emptying and cleaning of the water trap 130.

The shelf structure 100 is provided with mounting openings (not shown) and can be mounted on a vertical surface at any appropriate and convenient height and location. Usually, such a shelf structure will be located indoors and near an entrance to a residence. Hence, as residents or visitors enter and leave, they can conveniently remove and replace their wet weather apparel.

During their stay, the wet wearing apparel is conveniently stored on the tray 110 or one of the shelf members 115.

Use of the shelf structure 100 will prevent wetting and soiling of the floors of the residence from the water brought from outside the residence on or in the apparel.

Keeping the floors free of wet apparel and free water reduces the chances of accident due to tripping or slipping. Normally, the shelf assemblies 115 are in a first retracted position. The movable shelf elements 125 are collapsed with respect to the fixed shelf elements 120. In this condition, the shelf assemblies 115 are least intrusive.

However, if needed, the shelf assemblies 115 can be extended to accommodate apparel and shoes of different sizes by sliding the movable shelf elements 125 outwardly with respect to the fixed shelf elements 120. Any excess water, for example from melting snow or ice or rain, on the apparel will move under the influence of gravity, due to the incline of the tray 110 and fixed shelf elements 120, from the apparel down the tray 110 and shelf elements 115 towards the planar support member 106. The flow of excess water along the fixed shelf elements 120 is collected from the apparel in water grooves 139 located in the upper surface 136 of the fixed shelf elements 120 and flows under the influence of the slight positive angle of the fixed shelf elements 115 toward the planar support member 106.

The water flows into a water groove 141 that is located in a generally horizontal manner along the intersection of the fixed shelf elements 120 and the planar support member 106. The water in the water groove 141 flows to vertical openings 121 in the fixed shelf elements 120. The vertical openings 112 and 121 are aligned with generally vertical water grooves 140 in the planar support member 106. The water grooves 139, 140 and 141 assist with water flow from the apparel to the water trap 130 facilitating drying of the apparel by lessening the need for evaporation.

The water flowing from the apparel will pass through the openings 112 or 121 and continue downwardly in the generally vertical water grooves 141 along the planar support member 106 until it falls into the water trap 130.

Since certain changes may be made to the above system and apparatus without departing from the scope of the invention herein involved, it is intended that all matter contained in the above description or shown in the accompanying drawings shall be interpreted as illustrative and not in a limiting sense.

What is claimed is:

1. A shelf structure (100) for facilitating drying of wet wearing apparel and conducting water from such apparel to a water container the shelf structure comprising:

a frame member (105) having a thickness increasing from top to bottom, a water impervious planar member (106) supported by the frame member (105), said planar member (106) having a vertically oriented groove (140) in a surface thereof, a water impervious tray (110) mounted on an upper end of the frame member (105), the tray (110) including an upwardly extending lip (111) around the periphery thereof and having an opening (112) through the tray (110) communicating with said vertical groove (140);

a generally horizontal water impervious shelf assembly (115), located below said tray (110) and the shelf assembly (115) having a first stationary shelf element (120) fixed to the planar member (106) and a second movable shelf element (125) supported by said fixed shelf element (120) for telescoping movement with respect thereto, the fixed shelf element (120) including first and second intersecting grooves (139,141) in an upper surface (136) thereof, said second groove (141) being located at, and generally coextensive with, the intersection of the planar support member (106) and the fixed shelf element (115), said second groove (141) intersecting the vertical groove (140) in the planar member (106) and an opening (121) defined by said vertical groove (141) through the fixed shelf element (120), the movable shelf element (125) having an upwardly extending vertical lip (126) along a portion of the outer periphery thereof to facilitate water flow from the movable shelf element (125) to the fixed shelf element (120), and a trap (130) removably mounted on the frame member (105) for collecting and containing water from the wearing apparel.

2. The shelf structure (100) of claim 1 wherein the water impervious planar member, tray and shelf assembly are each comprised of a material that (100) is polypropylene.

3. The shelf structure (100) of claim 2 wherein said trap (130) is removably mounted on the supporting frame member (105) below said shelf assembly (115).

* * * * *